US008181579B2

(12) United States Patent
Leng

(10) Patent No.: US 8,181,579 B2
(45) Date of Patent: May 22, 2012

(54) PLASTIC AND WOOD COMPOSITE TABLETOP

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 368 days.

(21) Appl. No.: 12/431,023

(22) Filed: Apr. 28, 2009

(65) Prior Publication Data

US 2010/0043681 A1 Feb. 25, 2010

(30) Foreign Application Priority Data

Aug. 25, 2008 (CN) ..... 2008 1 0071653

(51) Int. Cl.
*A47B 17/00* (2006.01)

(52) U.S. Cl. ..... 108/27; 108/161

(58) Field of Classification Search ..... 108/27, 108/161, 180, 186, 157.1, 157.14, 153.1
See application file for complete search history.

(56) References Cited

U.S. PATENT DOCUMENTS

| | | | | | |
|---|---|---|---|---|---|
| 1,497,890 | A * | 6/1924 | Bros | 108/27 |
| 2,044,588 | A * | 6/1936 | Moore | 108/27 |
| 2,786,727 | A * | 3/1957 | Nordmark | 108/27 |
| 2,876,053 | A * | 3/1959 | Eves | 108/27 |
| 4,951,576 | A * | 8/1990 | Cobos et al. | 108/131 |
| 5,394,808 | A * | 3/1995 | Dutro et al. | 108/126 |
| 5,623,882 | A * | 4/1997 | Price | 108/129 |
| 5,694,865 | A * | 12/1997 | Raab | 108/161 |
| 5,947,037 | A * | 9/1999 | Hornberger et al. | 108/115 |
| 6,837,171 | B1 * | 1/2005 | Clark et al. | 108/131 |
| 7,249,745 | B2 * | 7/2007 | Moore et al. | 108/27 |
| 7,328,663 | B2 * | 2/2008 | Leng | 108/157.14 |
| 7,472,655 | B2 * | 1/2009 | Leng | 108/27 |

* cited by examiner

*Primary Examiner* — Jose V Chen
(74) *Attorney, Agent, or Firm* — Berdo & Berdo, P.C.

(57) ABSTRACT

A tabletop with a plastic surface board, a fiberboard and a frame. The plastic surface board has a top portion covering the top of the fiberboard, and a side portion covering the sides of the fiberboard. The end of the side portion and an edge of the bottom of the fiberboard defines a seam. The frame is continuous and supports the bottom of the fiberboard. The frame surrounds the plurality of sides, covers and protects the seam.

9 Claims, 5 Drawing Sheets

PLASTIC AND WOOD COMPOSITE TABLETOP

FIELD OF THE INVENTION

The present invention relates to a tabletop and, in particular, to an improved tabletop of bridge table.

BACKGROUND OF THE INVENTION

Conventional bridge tabletop (foldable table with simple structure) usually included by frame, PVC film and fiberboard, the PVC film covered on the top of the fiberboard, and the periphery of the film folded inwardly and is fixed on the fiberboard by nails, then fixed on the frame via connecting strips, thus the tabletop of conventional table is made. However, the soft PVC film of this tabletop made the tabletop to be rough, not durable, easily-scared, and the product is low-grade. The nailing connecting make that being not good manufacturability, rough bottom side, low production efficiency and irregular appearance, and the quality is not easy to be controlled.

SUMMARY OF THE INVENTION

The primary object of the present invention is to providing a plastic and wood composite tabletop which has simple structure, high quality and low cost.

The object of the invention is achieved by providing a plastic and wood composite tabletop comprising a plastic surface board, a fiberboard, and a frame. As can be seen in FIGS. 3-10, the plastic surface board is substantially thinner than the fiberboard, generally covers the top surface of the fiberboard as well as the whole or upper portion of the side surface of the fiberboard. It should be apparent to a person skilled in the art that the term "fiberboard" used herein, includes other type of boards, for example, particleboard or wood board. The frame provides reinforcement and serves as a connecting piece of the tabletop. The frame is set on the side surface and/or the lower edge of the fiberboard.

The frame is made of metal, for example, steel or aluminum. Other material with sufficient rigidity also can be used.

The frame is fixed with the fiberboard via connecting strips.

The plastic surface board includes side surfaces extending from the plastic surface board. The side surfaces cover the sides of the fiberboard. The whole plastic surface board may be made by vacuum molding. As can be seen in FIGS. 3-8, the side portion of the plastic surface board extends vertically, wraps the sides of the fiberboard and may reach the bottom of the sides of the fiberboard, the lower end of the side portion and the edge of the bottom planar surface of the fiberboard therefore form a seam.

The plastic surface board may have a film with patterns. The plastic surface board adheres to the fiberboard by partial or whole gluing.

The frame is arranged at the joint position where the plastic surface board and the fiberboard meet. The frame covers the seam between the side surfaces of the plastic surface board and the fiberboard. The frame is also used as the supporting frame of the surface board.

A sealing strip may be disposed on the edge of the plastic surface board. The sealing strip is an injection moulding or an extrusion moulding and having an inner side connecting to the frame.

The lower portion of the out side of said sealing strip has a step sealed on the outside of the plastic surface board. The inner side of the sealing strip is connected to the frame by gluing, locking connection or nailing.

The outside of said sealing strip connecting with the edge of the vacuum-moulding board by gluing or melding.

The present invention widens the application field of the fiberboard in the mid-range furniture. Traditionally, the fiberboard can only be used as clapboard of drawer, table or cupboard in conventional furniture, although plastic film or paster can be composite to the surface of the fiberboard, the surface is still not good enough because the surface of the fiberboard is rough. Secondly, the fiberboard is lower-cost, but has lower resistance to breakage, and can not be used in a large stress acreage such as a tabletop, the present invention integrate the surface decoration into the reinforcement of the fiberboard. Compared with conventional blow-molding tabletop, although conventional blow-molding tabletop is hollow, but the plastic layers on the top and the bottom are thick, and must be supported by the frame. The present invention only uses a layer of plastic surface board, and the resistance to breakage is higher than the blow-molding tabletop, and has abroad material resource and simple manufacture process.

DESCRIPTION OF THE PREFERRED EMBODIMENT

Figure 1:
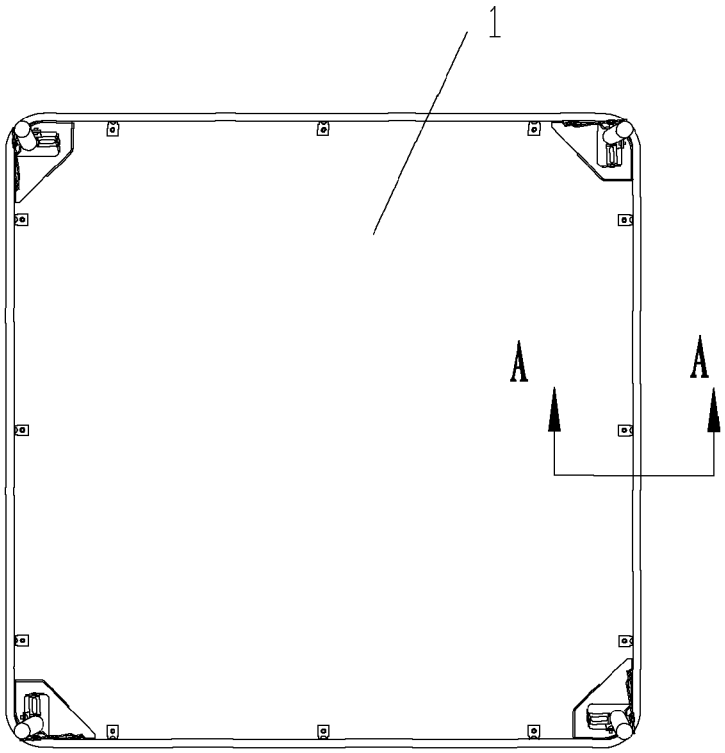
FIG. 1 is a top view of a foldable table of the present invention.
Figure 2:
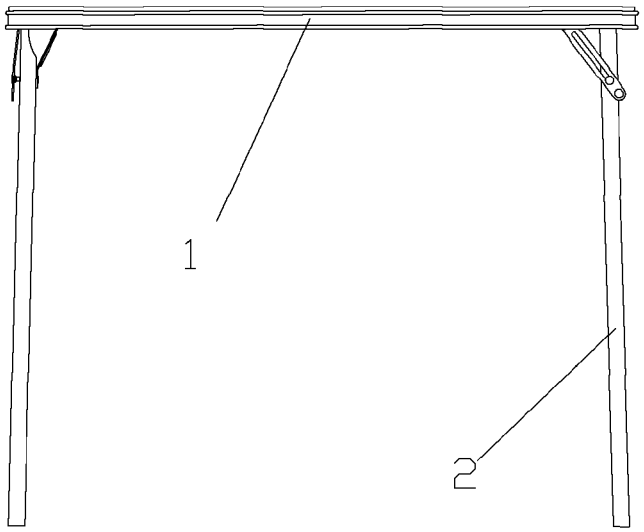
FIG. 2 is a front view of a foldable table of the present invention.
Figure 3:
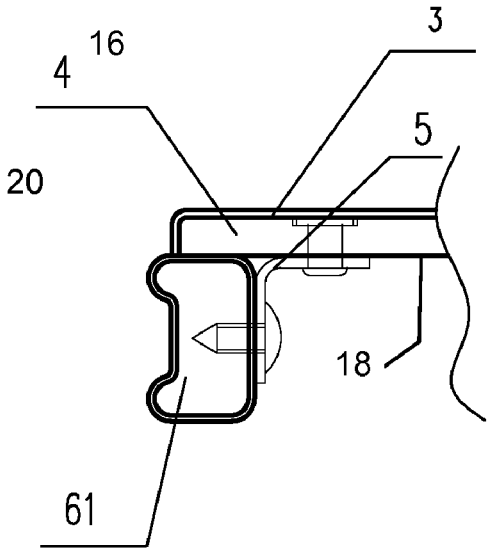
FIG. 3 is a partial sectional view along A-A of the tabletop in embodiment 1.

Embodiment 1:

Referring to FIGS. 1, 2 and 3, the tabletop of the foldable table 1 comprising a fiberboard 4, a vacuum-molding plastic surface board 3, and a frame 61, the fiberboard 4 has a top surface 16, a bottom planar surface 18 and four sides. Referring to FIG. 3, the plastic surface board includes a top portion which covers the top surface 16, and a side portion which extends from the top portion. The side portion wraps the sides of the fiberboard. The lower end of the side portion of the plastic surface board is in direct contact and substantially flush with the edge of the planar bottom surface 18. The lower end of the side portion and the edge of the bottom planar surface form a seam 20. The frame 61 is placed under the lower edge of the tabletop and hides the seam 20 between the edge of the bottom planar surface and the side portion of the plastic surface board, the frame 61 is connected with the tabletop via a connecting strip 5, and the leg 2 is connected to the frame 61.

Figure 4:
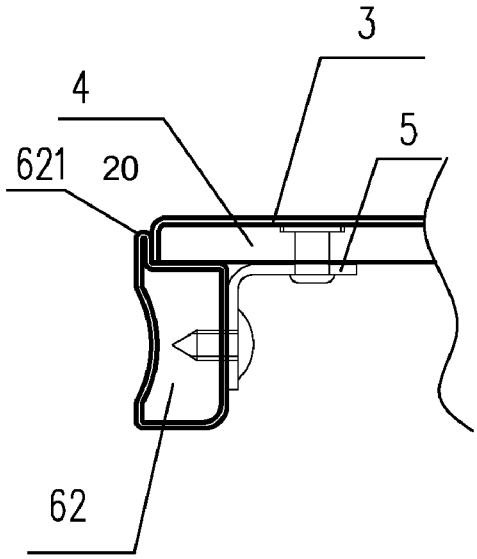
FIG. 4 is a partial sectional view along A-A of the tabletop in embodiment 2.

Embodiment 2:

Referring to FIG. 4, the structure of tabletop is similar to embodiment 1, the difference is that in this embodiment the frame 62 has a fringe 621 extending upwardly to the side of the tabletop.

Figure 5:
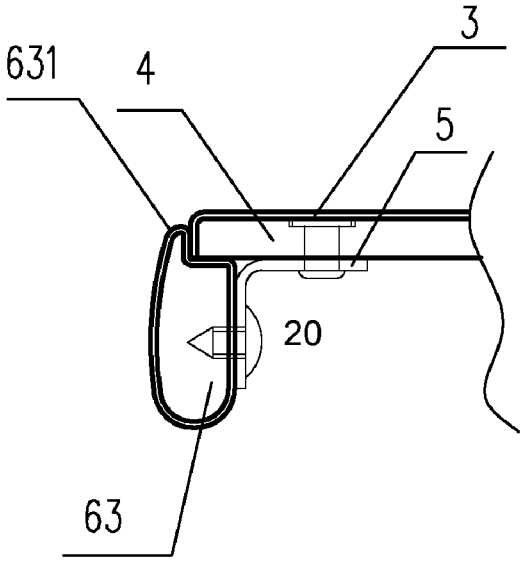
FIG. 5 is a partial sectional view along A-A of the tabletop in embodiment 3.

Embodiment 3:

Referring to FIG. 5, the structure of tabletop is similar to embodiment 1, the difference is that in this embodiment the frame 63 has a fringe 631 extends upwardly to the side of the tabletop, and the outside of the frame has an arc shape.

Figure 6:
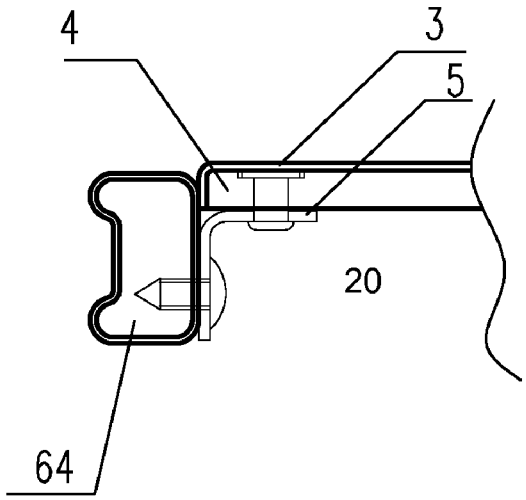
FIG. 6 is a partial sectional view along A-A of the tabletop in embodiment 4.

Embodiment 4:

Referring to FIG. 6, the structure of tabletop is similar to embodiment 1, the difference is that in this embodiment the frame 64 is set in the side of the tabletop and connected to the tabletop via a connecting strip 5.

Figure 7:
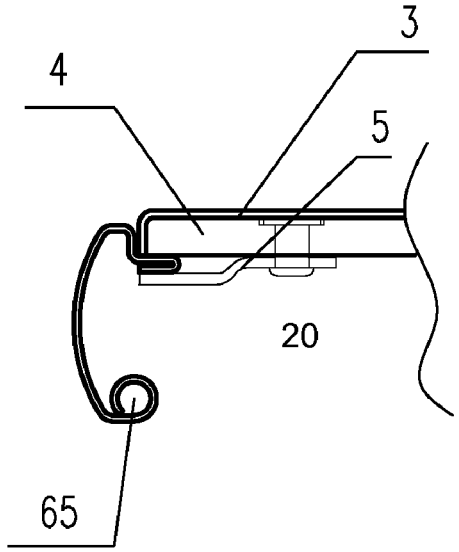
FIG. 7 is a partial sectional view along A-A of the tabletop in embodiment 5.
Figure 8:
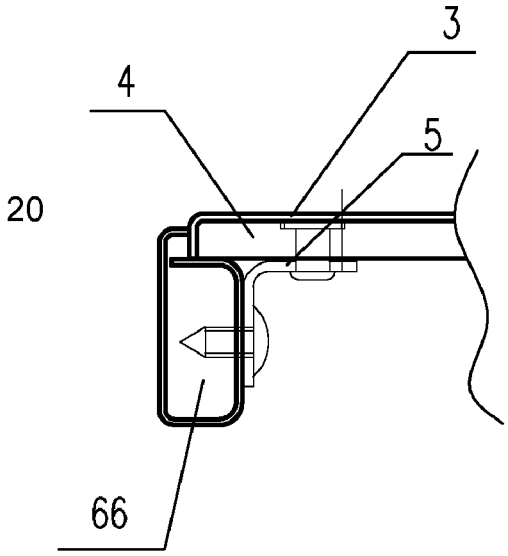
FIG. 8 is a partial sectional view along A-A of the tabletop in embodiment 6.

Embodiment 5:

Referring to FIG. 7, the structure of tabletop is similar to embodiment 1, the difference is that in this embodiment the frame 65 is single-layer.

Embodiment 6:

Referring to FIG. 7, the structure of tabletop is similar to embodiment 1, the difference is that in this embodiment the frame 66 is G-shaped.

Figure 9:
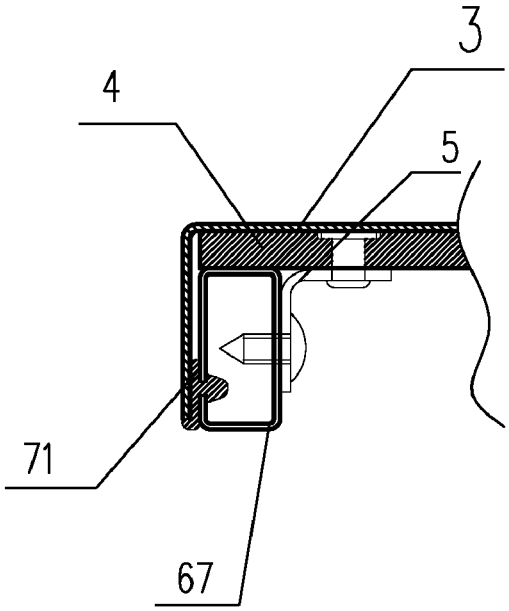
FIG. 9 is a partial sectional view along A-A of the tabletop in embodiment 7.

Embodiment 7:

Referring to FIG 9, the structure of tabletop is similar to embodiment 1, the difference is that in this embodiment a sealing strip 71 disposed on the outside of the vacuum-molding plastic surface board, the out side of the sealing strip has a step for sealing the outside of the vacuum-molding plastic, and the inner side of the sealing strip has a nail which inserted into the frame 67.

Figure 10:
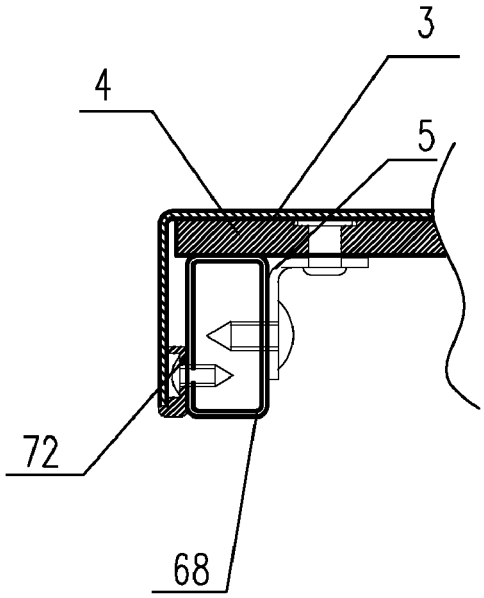
FIG. 10 is a partial sectional view along A-A of the tabletop in embodiment 8.

Embodiment 8:

Referring to FIG. 10, the structure of tabletop is similar to embodiment 1, the difference is that in this embodiment a sealing strip 72 disposed on the outside of the vacuum-molding plastic surface board, the outside of the sealing strip has a step for sealing the outside of the vacuum-molding plastic, and the inner side of the sealing strip is connected to the frame 68 via a nail.

It is understood that the invention is not confined to the particular construction and arrangement of parts herein illustrated and described, but embraces such modified forms thereof as come within the scope of the following claims.

What is claimed is:

1. A tabletop comprising:

a fiberboard having a top surface, a planar bottom surface and a plurality of sides;

a plastic surface board comprising:

a top portion covering the top surface; and a side portion extending from the top portion and directly wrapping the plurality of sides of said fiberboard, the side portion having a lower end that is substantially flush with an edge of the planar bottom surface and is in direct contact with the edge of the planar bottom surface, the lower end of the side portion and the edge of the planar bottom surface forming a seam;

a continuous frame supporting the bottom of the fiberboard, the continuous frame surrounding the plurality of sides, covering and protecting the seam.

2. The tabletop according to claim 1, wherein said frame is metal.

3. The tabletop according to claim 1, wherein said frame is connected with said fiberboard via connecting strips.

4. The tabletop according to claim 3, further comprising a sealing strip extending from an edge of said plastic surface board, the sealing strip having an inner side connected to the frame.

5. The tabletop according to claim 4, wherein a lower portion of an exterior side of said sealing strip has a step sealed on the exterior side of the plastic surface board, the inner side of said sealing strip connecting to said frame by gluing, locking or nailing.

6. The tabletop according to claim 4, wherein the exterior side of said sealing strip connecting with the edge of the vacuum-moulding board by gluing or melding.

7. The tabletop according to claim 1, wherein said plastic surface board is made by vacuum molding.

8. The tabletop according to claim 1, wherein said plastic surface board adheres to said fiberboard by partial or whole gluing.

9. The tabletop according to claim 1, wherein said fiberboard is a particleboard or a wood board.

* * * * *

UNITED STATES PATENT AND TRADEMARK OFFICE

CERTIFICATE OF CORRECTION

PATENT NO. : 8,181,579 B2
APPLICATION NO. : 12/431023
DATED : May 22, 2012
INVENTOR(S) : Luhao Leng It is certified that error appears in the above-identified patent and that said Letters Patent is hereby corrected as shown below:

Title Page, Item 74 (Attorney, Agent, or Firm)

"Berdo & Berdo, P.C." should be changed to --Rabin & Berdo, P.C.--

Signed and Sealed this
Eighteenth Day of December, 2012

David J. Kappos

David J. Kappos
*Director of the United States Patent and Trademark Office*